US009416484B2

(12) United States Patent
Campagnolo et al.

(10) Patent No.: US 9,416,484 B2
(45) Date of Patent: Aug. 16, 2016

(54) HOUSEHOLD APPLIANCE

(76) Inventors: Flavio Campagnolo, Conegliano (IT); Nicola Reid, Pordenone (IT); Elisabetta Bari, Portogruaro (IT)

( * ) Notice: Subject to any disclaimer, the term of this patent is extended or adjusted under 35 U.S.C. 154(b) by 1132 days.

(21) Appl. No.: 12/296,956

(22) PCT Filed: Mar. 6, 2007

(86) PCT No.: PCT/EP2007/001900
§ 371 (c)(1),
(2), (4) Date: Oct. 13, 2008

(87) PCT Pub. No.: WO2007/118551
PCT Pub. Date: Oct. 25, 2007

(65) Prior Publication Data

US 2009/0172965 A1 Jul. 9, 2009

(30) Foreign Application Priority Data

Apr. 14, 2006 (EP) ..... 06112671

(51) Int. Cl.
*D06F 58/16* (2006.01)
*D06F 58/20* (2006.01)

(52) U.S. Cl.
CPC ..... *D06F 58/16* (2013.01); *D06F 58/20* (2013.01)

(58) Field of Classification Search
CPC ..... D06F 58/16; D06F 58/20
USPC ..... 34/85, 513, 140, 72, 73, 237, 122
See application file for complete search history.

(56) References Cited

U.S. PATENT DOCUMENTS 4,763,425 A * 8/1988 Grennan ..... 34/552
4,819,341 A * 4/1989 Gayso ..... 34/86
2004/0250442 A1* 12/2004 Ryu ..... 34/140

FOREIGN PATENT DOCUMENTS

DE 2740652 A1 3/1979
EP 1146161 A1 * 10/2001
EP 1431442 A 6/2004
JP 54108060 A * 8/1979

OTHER PUBLICATIONS

International Search Report for PCT/EP2007/001900, dated May 30, 2007, 2 pages.

* cited by examiner

*Primary Examiner* — Jiping Lu
(74) *Attorney, Agent, or Firm* — Pearne & Gordon LLP

(57) ABSTRACT

Household appliance comprising an outer casing (2) provided with a worktop (3), wherein said worktop (3) comprises a plurality of apertures (7), each one of which is fluidly connected with conveying means adapted to deliver a flow of air through said apertures (7) for drying garments laid upon the same worktop.

32 Claims, 4 Drawing Sheets

HOUSEHOLD APPLIANCE

BACKGROUND OF THE INVENTION

The present invention refers to a household appliance and in particular to a household appliance for washing and/or drying clothes.

It is a largely known fact that garments made of delicate textile materials, such as cashmere, are not adapted to undergo regular drying treatments in a tumble dryer, owing to the mechanical stresses, mainly in the form of impacts, which the textile fibres would be subject to there.

For these delicate textiles to be properly taken care of, they therefore need to be dried by means of more gentle treatments, such as line-drying or flat drying, which on the other hand are rather time-consuming processes.

BRIEF SUMMARY OF THE INVENTION

The object of the present invention is therefore to provide a household appliance capable of drying clothes in a gentle manner, thereby eliminating all drawbacks cited above in connection with the prior art.

Within this general object, it is a main purpose of the present invention to provide a novel drying concept and solution for household appliances, which is relatively simple in construction, trouble-free in operation, dependable, flexible in use, and relatively inexpensive to manufacture, operate, service and maintain.

According to the present invention, these aims are reached in a household appliance incorporating the characteristics as recited and defined in the appended claims.

BRIEF DESCRIPTION OF THE DRAWINGS

Features and advantages of the present invention will anyway be more readily understood from the description that is given below by way of non-limiting example with reference to the accompanying drawings, in which.

DETAILED DESCRIPTION OF THE PREFERRED EMBODIMENTS

Figure 1:
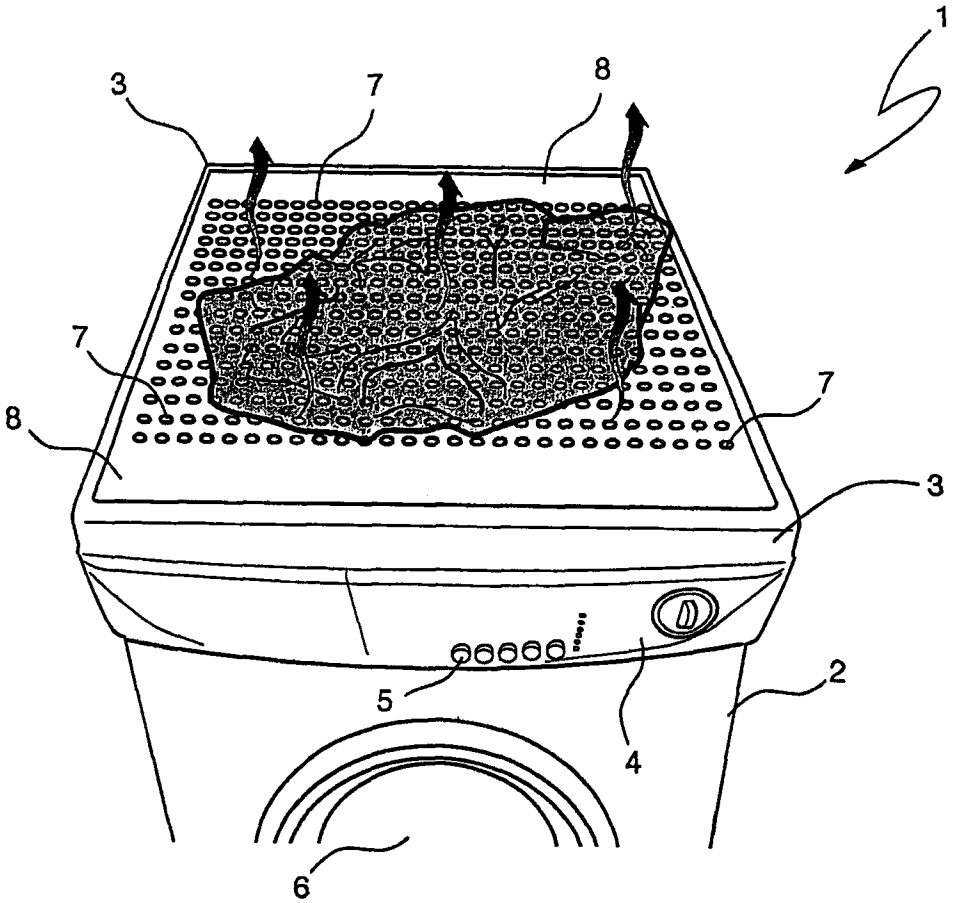
FIG. 1 is a perspective front view of a household appliance according to the present invention.
Figure 2:
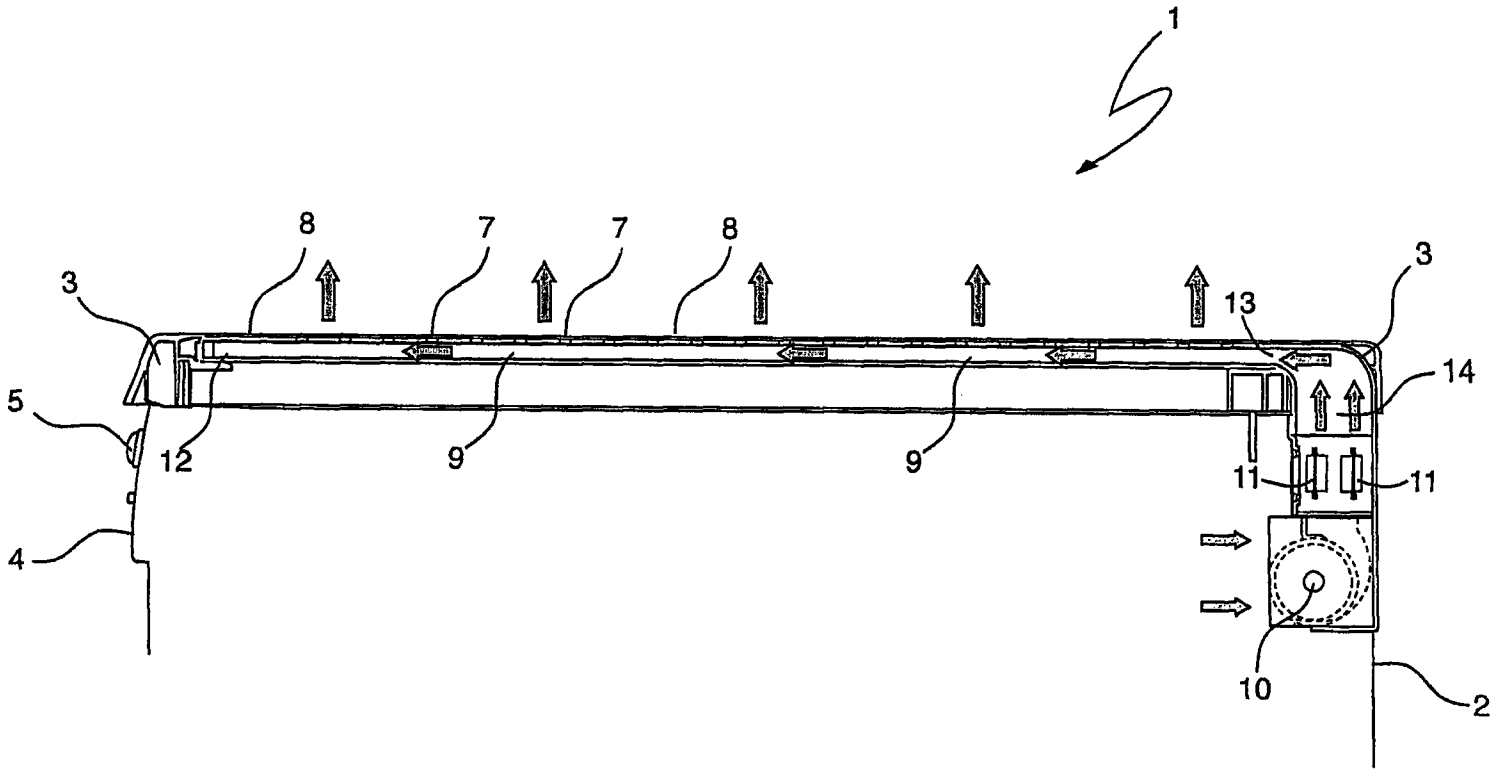
FIG. 2 is a side cross-sectional view of the household appliance shown in FIG. 1.

The household appliance, in particular for washing and/or drying clothes, according to the present invention, as generally indicated with the reference numeral 1 in the Figures, comprises an outer casing 2 with a worktop 3 and a front panel 4 carrying operational input and setting controls 5, a drum rotatably supported inside the outer casing 2 and adapted to be loaded with the items to be washed and/or dried, an opening for loading and unloading the items into and from the drum, and a door 6 for closing said opening.

The worktop 3 defines a plurality of apertures 7, each one of which is fluidly connected with conveying means adapted to direct a flow of air through said apertures 7 for drying garments that are laid upon the worktop to this purpose.

In fact, the worktop 3 defines a drying surface 8, on which the garment to be dried is laid. This drying surface 8 comprises a plurality of apertures or perforations 7, through which air is caused to flow so as to hit the garment, thereby drying it.

In a preferred embodiments the conveying means, which are provided to direct the flow of air intended for drying the garment towards and through said apertures, are situated inside the outer casing 2 below the drying surface 8 defined by the worktop 3, as shown in FIG. 1.

These conveying means comprise at least an air passage 9 adapted to convey the air up to the worktop 3 underneath the drying surface 8, so that the air is then able to flow through the apertures 7 from the bottom upwards, as well as air circulating means 10 adapted to force a flow of air into and through the air passage 9.

In an advantageous manner, heating means 11 are provided to heat up the air that flows into the air passage 9, so that it is appropriately heated-up air that eventually hits the garment to be dried.

In the embodiment being discussed, the air passage 9 extends horizontally along the drying surface 8, so as to be able to supply air to each single aperture 7 at the same time. An end portion 12 of the air passage 9 is blind, i.e. sealed, whereas the other end portion 13 thereof is open and fluidly communicating with the air circulating means 10 to receive the flow of drying air thereinto.

Advantageously, the air passage 9 is formed in the worktop 3 integrally.

The air circulating means 10 may for instance be comprised of at least a blower arranged inside the outer casing 2 of the appliance and adapted to take in air form either the interior or the exterior of the household appliance to convey it into the air passage 9.

In particular, the blower is housed in a proper accommodation provided to this purpose inside the outer casing of the appliance.

The conveying means further comprise a communication duct 14 provided in the worktop and/or the outer casing to connect the air circulating means 10 with the air passage 9.

The heating means 11 may for instance be comprised of one or more electric heating elements arranged downstream from the air circulating means 10 and upstream of the air passage 9. In the particular embodiment being described, the heating means 11 are housed inside the communication duct 14, upstream of the open end portion 13 of the air passage 9.

In an alternative embodiment of the present invention the conveying means are provided outside the casing.

Figure 3:
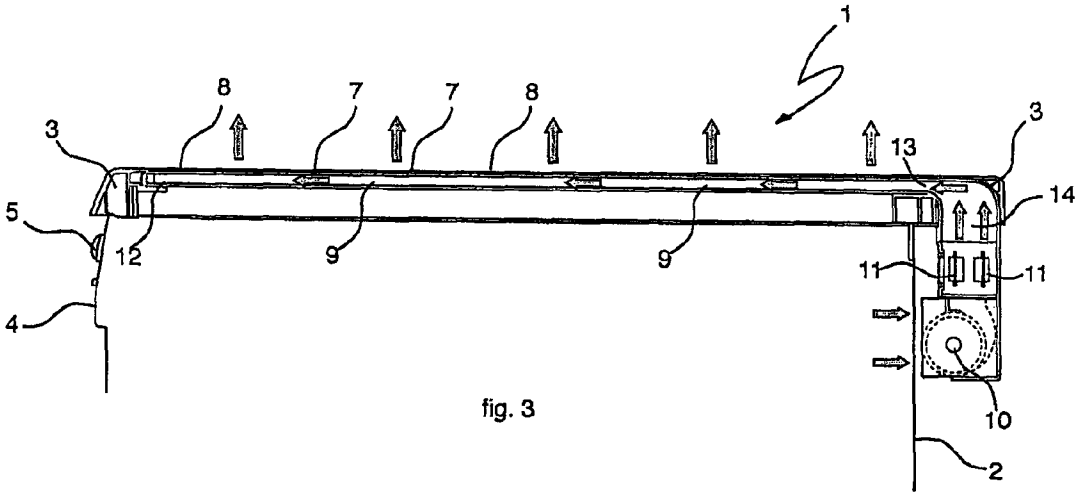
FIG. 3 is a side cross-sectional view of a second embodiment of the household appliance according to the present invention.

In particular, for example, the air circulating means 10 and the communication duct 14 are associated to the upper backward portion of the casing in proximity to and below the worktop projecting from the casing, as shown in FIG. 3.

Figure 4:
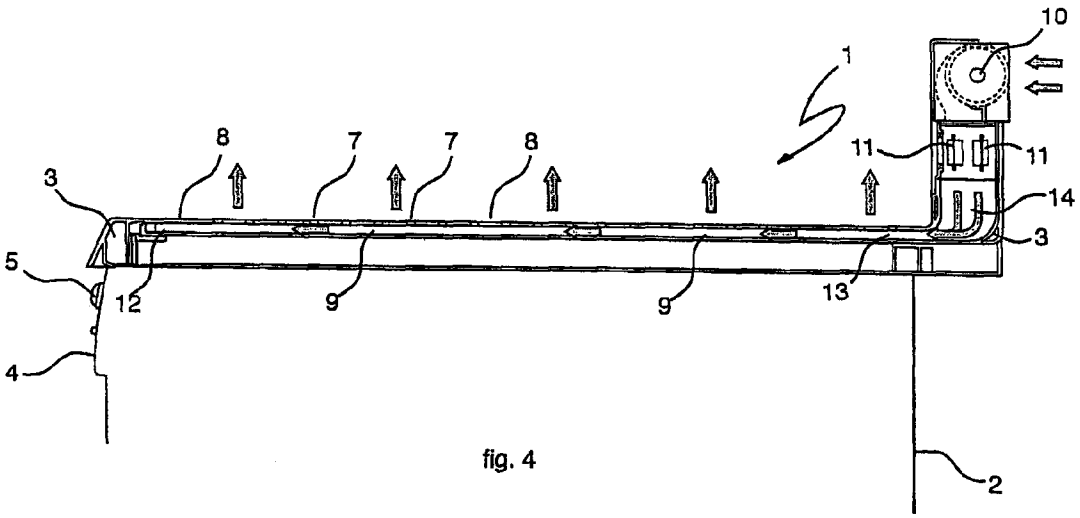
FIG. 4 is a side cross-sectional view of a further embodiment of the household appliance according to the present invention.

In a further embodiment the air circulating means 10 and the communication duct 14 are arranged above the worktop in fluidly connection with the air passage 9, as shown in FIG. 4.

The above-described drying arrangement may be provided on a washing machine, a tumble dryer or a so-called washer-dryer, wherein it will be readily appreciated that a perforated worktop as described above may even be applied to top-loading appliances.

It will however be also readily appreciated that a drying arrangement of the above described kind may be provided in the form of a self-standing, i.e. autonomous household appliance specially intended for drying delicate garments, which is designed to integrally comprise a perforated drying surface and air conveying means as described above.

The household appliance comprises control means to enable the air circulating means 10 and the heating means 11 to be switched on as required, as well as the different drying modes of the appliance to be properly selected. In this connection, it should in fact be noticed that different drying temperatures and different drying times may be required to most properly handle the various garments to be dried, depending, among other things, on the textile fibres which each single garment is made of.

Such control means are arranged on the front panel 4 of the washing and/or drying machine or on a specific console provided on the self-standing appliance.

Figure 5:
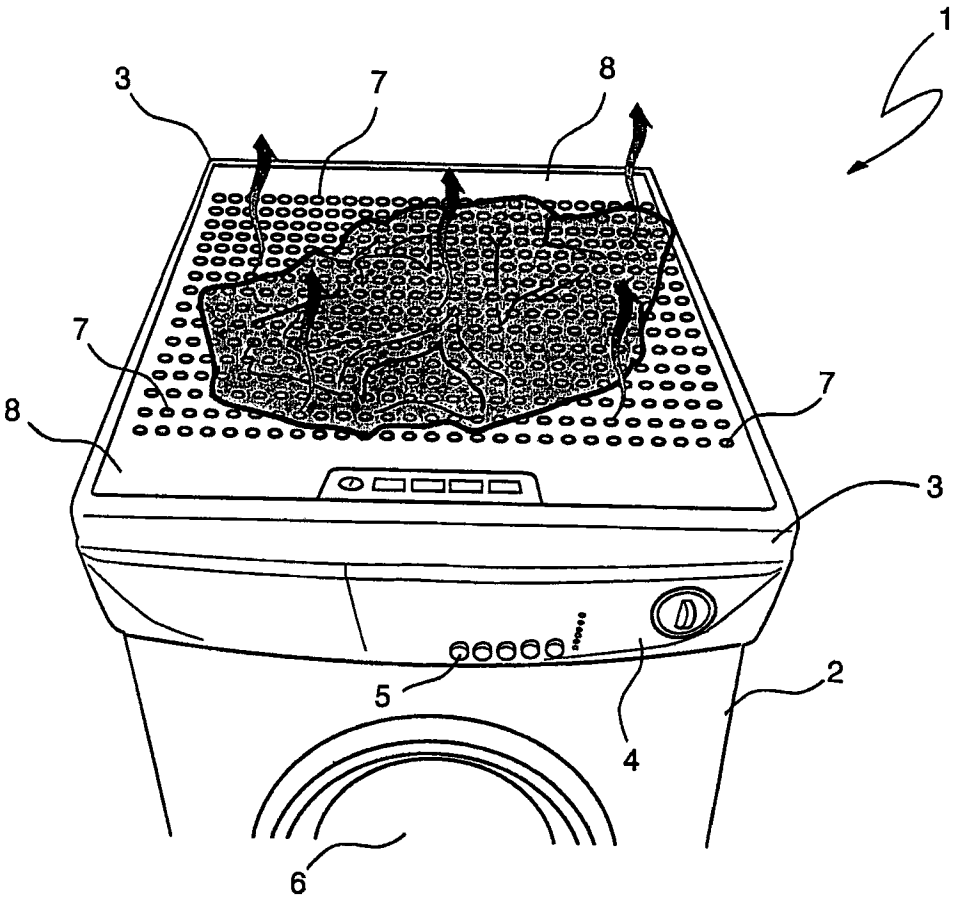
FIG. 5 is a perspective front view of a household appliance according to the present invention showing the control means integrated on the worktop.

In another embodiment the control means are directly integrated on the worktop of the washing and/or drying machine or on the worktop of the self-standing appliance, as shown in FIG. 5.

It can therefore be conclusively stated that, with the arrangement according to the present invention, delicate textiles can be gently and effectively dried in a most convenient manner, without this implying any large energy usage, thereby doing away with the typical drawbacks shared by prior-art machines used to dry clothes.

In this connection, it should further be noticed that the household appliance according to the present invention may advantageously be used to also quickly and effectively warm up and dry bathroom towels or bathrobes before and after using them, respectively, as well as to dry kitchen towels.

Advantageously the household appliance according to the present invention can be used to warm the room where the appliance is located, in particular, for example, the bathroom. In fact, when no garment is present upon the worktop, hot and dry air is adapted to be discharged to the atmosphere through the apertures 7 by means of the blower and the electric heating elements. For this purpose, control means are provided to operate the air circulating means 10 and the heating means 11 according to a specifically intended warm-up mode in order to heat up the air of the room where the appliance is located.

The invention claimed is:

1. Washing and/or drying machine comprising:

an outer casing (2) including a front wall, a rear wall, side walls, and a worktop (3) forming the top wall of the outer casing (2);

a drum rotatably supported inside the outer casing (2) and adapted to be loaded with items to be washed and/or dried, wherein the top wall comprises a plurality of apertures (7), each one of which is fluidly connected to at least an air passage (9) integrally formed in the worktop (3) and adapted to deliver a flow of air through said apertures (7) for drying garments laid upon the same worktop;

air circulating means (10) for taking in ambient air and forcing said ambient air through the air passage (9); and an electric heating element (11) arranged proximate to the worktop (3) for heating up the air to be directed through the apertures (7).

2. Washing machine according to claim 1, wherein said worktop (3) defines a drying surface (8), upon which the garment to be dried is due to be laid, said drying surface (8) being provided with said apertures (7) through which the air is adapted to flow so as to hit the garment to be dried.

3. Washing and/or drying machine according to claim 2, wherein the air passage (9) is adapted to convey the air underneath the drying surface (8).

4. Washing and/or drying machine according to any of the preceding claims, comprising:

control means to enable the air circulating means (10) and the electric heating element (11) to be switched on and operated as required.

5. Washing machine or tumble dryer appliance according to claim 4, wherein said control means are provided to enable different drying temperatures and different drying times to most properly handle the various garments to be dried, depending on the textile fibres which each single garment is made of.

6. Washing machine or tumble dryer according to claim 4, wherein said control means are provided to operate the air circulating means (10) and the heating means (11) according to a specifically intended warm-up mode in order to heat up the air of the room where the appliance is located.

7. Washing and/or drying machine according to claim 4, wherein said control means are directly integrated on the worktop (3).

8. Washing and/or drying machine according to claim 1, comprising air circulating means (10) for taking air from the ambient where the machine is located and forcing said air through the air passage (9).

9. Washing and/or drying machine according to claim 8, wherein the air circulating means (10) are associated to the worktop (3).

10. Washing and/or drying machine according to claim 8, wherein the air circulating means (10) are arranged in correspondence to the worktop (3).

11. Washing and/or drying machine according to claim 8, wherein the air circulating means (10) are arranged above the drum in proximity of the worktop (3).

12. Washing and/or drying machine according to any one of claims 1, 2, 3 and 8-11, wherein the air circulating means (10) comprise a blower.

13. Washing and/or drying machine according to any one of claims 1, 2, 3 and 8-11, wherein at least an electric heating element (11) is arranged in correspondence to the worktop (3) for heating up the air to be directed through the apertures (7).

14. Washing and/or drying machine according to claim 13, wherein the electric heating element (11) is arranged above the drum in proximity of the worktop (3).

15. Washing and/or drying machine according to claim 13, wherein said electric heating element (11) is arranged downstream from said blower and upstream from the air passage (9).

16. Washing and/or drying machine according to claim 1, wherein the air circulating means (10) and the electric heating element (11) are located proximate the rear wall of the outer casing (2).

17. Washing and/or drying machine according to claim 1, wherein the worktop comprises an inlet port to draw in the ambient air from outside the outer casing.

18. Washing and/or drying machine according to claim 17, wherein the inlet port is fluidly connected to the air passage (9).

19. Washing and/or drying machine comprising a front wall, a rear wall, side walls and a top wall (8) forming an outer casing (2) of the machine, a drum is supported inside the outer casing (2) and adapted to be loaded with items to be washed and/or dried, the machine is provided with a worktop (3) which defines the top wall (8), wherein said top wall (8) comprises a plurality of apertures (7), each one of which is fluidly connected with conveying means adapted to deliver a flow of air through said apertures (7) for drying garments laid upon the same top wall (8).

20. Washing and/or drying machine according to claim 19, wherein said worktop (3) is fixed to the front wall, to the rear wall and to the side walls.

21. Washing and/or drying machine according to claim 19, wherein the apertures (7) and the top wall (8) forms a single piece construction.

22. Washing and/or drying machine according to claim 19, wherein said conveying means are located inside the outer casing (2) of the appliance, below the top wall (8) of the worktop (3).

23. Washing and/or drying machine according to claim 19, wherein said conveying means comprise at least an air passage (9) adapted to convey the air up to and along the worktop (3) underneath the top wall (8), so that the air is able to flow through the apertures (7) from the bottom upwards, and air circulating means (10) adapted to force a flow of air into and through the air passage (9).

24. Washing and/or drying machine according to claim 23, wherein said conveying means comprise the air circulating means (10) for taking air from the ambient where the machine is located and forcing said air through the air passage (9).

25. Washing and/or drying machine according to claim 23, wherein heating means (11) are provided to heat up the air, so that it is properly heated-up air that eventually hits the garment to be dried.

26. Washing and/or drying machine according to claim 25, wherein the heating means (11) are arranged downstream from the air circulating means (10) and upstream of the air passage (9).

27. Washing and/or drying machine according to claim 25, comprising control means to enable the air circulating means (10) and the heating means (11) to be switched on and operated as required.

28. Washing and/or drying machine according to claim 27, wherein said control means are provided to enable different drying temperatures and different drying times to most properly handle the various garments to be dried, depending on the textile fibres which each single garment is made of.

29. Washing and/or drying machine according to claim 27, wherein said control means are provided to operate the air circulating means (10) and the heating means (11) according to a specifically intended warm-up mode in order to heat up the air of the room where the appliance is located.

30. Washing and/or drying machine according to claim 27, wherein said control means are directly integrated on the worktop (3).

31. Washing and/or drying machine according to claim 23, wherein said air passage (9) extends along the top wall (8) and defines an open end portion (13) fluidly communicating with the air circulating means (10) to receive the flow of drying air thereinto.

32. Washing and/or drying machine according to claim 19, wherein said conveying means comprise at least an air passage (9) integrally formed in the worktop (3).

* * * * *